US005751255A

United States Patent [19]

Carter, Jr.

[11] Patent Number: 5,751,255

[45] Date of Patent: May 12, 1998

[54] ELECTRICALLY SMALL RECEIVING ANTENNAS

[76] Inventor: Philip S. Carter, Jr., 221 Iris Way, Palo Alto, Calif. 94303

[21] Appl. No.: 659,929

[22] Filed: Jun. 7, 1996

[51] Int. Cl.[6] ..... H01Q 7/00

[52] U.S. Cl. ..... 343/866; 343/741; 343/744; 343/870

[58] Field of Search ..... 343/700 MS, 741, 343/742, 860, 864, 866, 867, 868, 870, 744; 340/505, 572

[56] References Cited

U.S. PATENT DOCUMENTS

| | | | |
|---|---|---|---|
| 2,465,381 | 3/1949 | Libby | 343/867 |
| 2,479,337 | 5/1949 | Fyler | 343/742 |
| 2,615,143 | 10/1952 | Carter | 343/742 |
| 3,210,766 | 10/1965 | Parker | 343/866 |
| 3,902,177 | 8/1975 | Mori et al. | 343/741 |
| 4,342,999 | 8/1982 | Woodward et al. | 343/702 |
| 4,384,281 | 5/1983 | Cooper | 340/572 |
| 4,823,141 | 4/1989 | Ohe et al. | 343/866 |
| 4,847,626 | 7/1989 | Kahler et al. | 343/700 MS |
| 4,983,985 | 1/1991 | Beatty | 343/866 |
| 5,373,301 | 12/1994 | Bowers et al. | 343/867 |
| 5,485,165 | 1/1996 | Foard | 343/741 |

*Primary Examiner*—Donald T. Hajec
*Assistant Examiner*—Tan Ho
*Attorney, Agent, or Firm*—Howard L. Rose

[57] ABSTRACT

A small loop antenna employs circuits for increasing the power output and bandwidth of such antennas by employing coaxial cable or wide antenna elements on which the coaxial cable may be mounted or use microstrip, both for the purpose of reducing the inductance and resistance of the antenna structure in a fixed ratio so that the reduced terminating resistance increases the level of signal output. This method applies to both receiving and transmitting antennas for cases where the terminating resistance is much larger than the radiation resistance plus the antenna and tuner loss resistances.

12 Claims, 6 Drawing Sheets

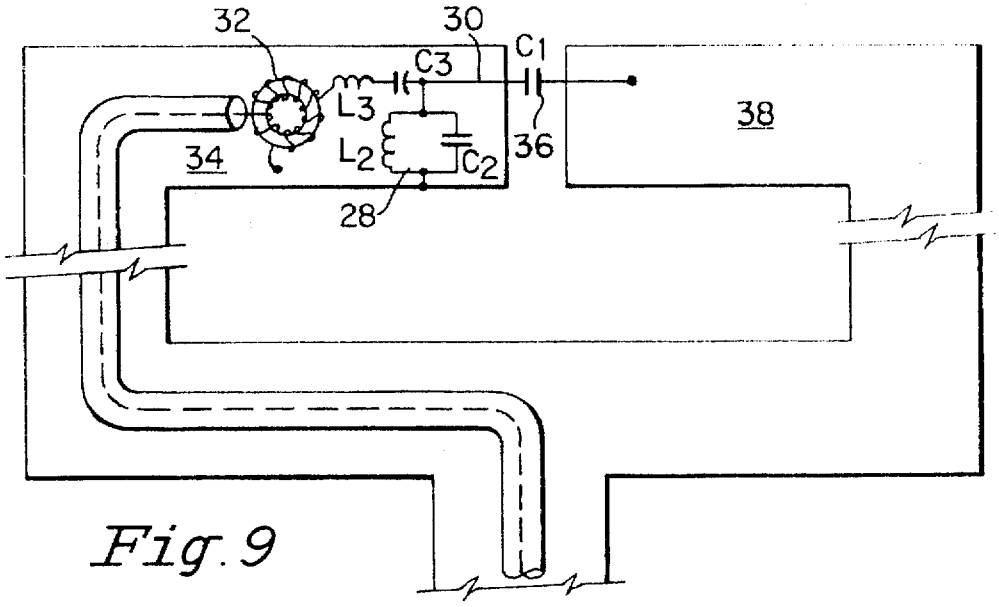
Fig. 9
Fig. 10
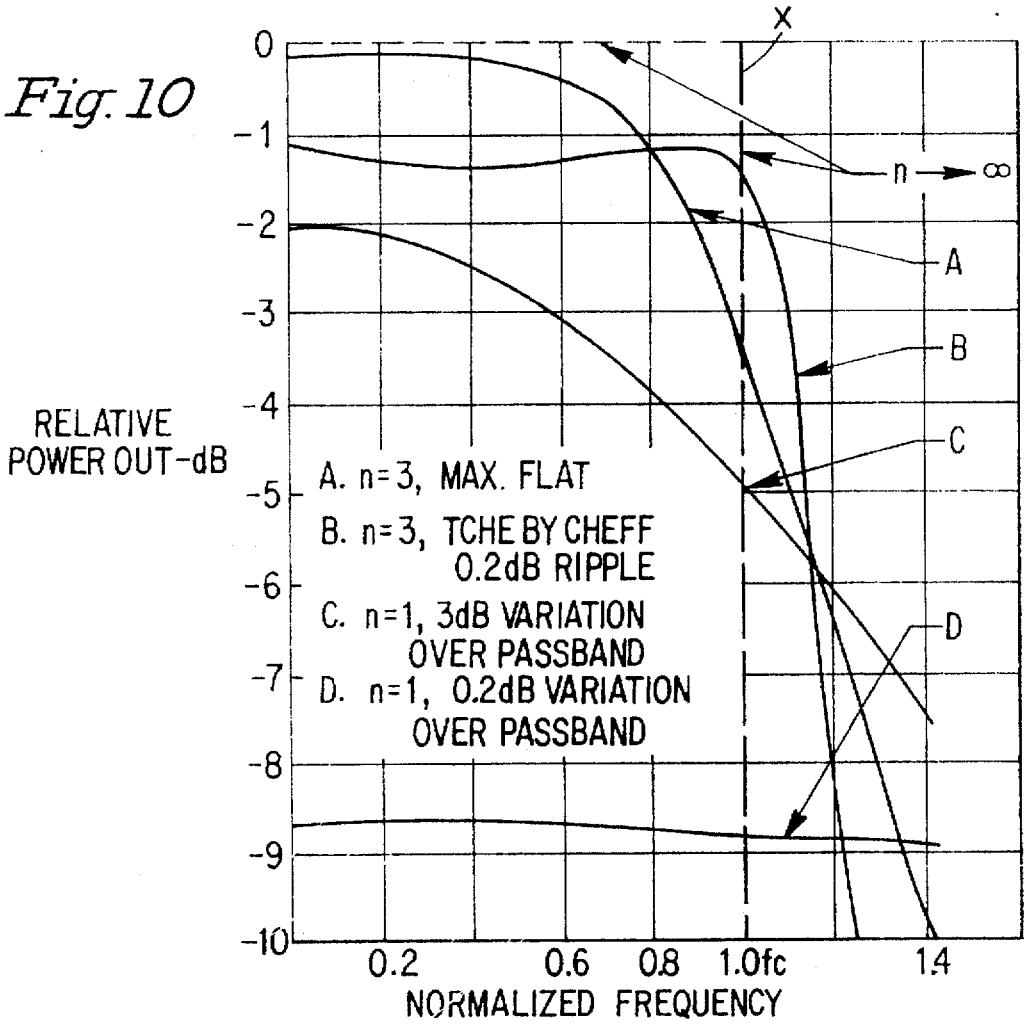

ELECTRICALLY SMALL RECEIVING ANTENNAS

FIELD OF THE INVENTION

The present invention relates to loop antennas and more particularly to optimizing power output of a loop antenna for a given bandwidth.

BACKGROUND OF THE INVENTION

Antennas that are small, that is the major dimension is far less than one wavelength at the operating frequencies, are characterized as inductive (magnetic dipole) or capacitive (electric dipole) antennas.

A conventional small loop antenna may comprise two C-shaped members; one a coax cable serving as a transmission line for introducing to or extracting signals from the antenna. The other C-shaped member serves as the antenna proper and is joined at one end to the outer conductor of the coax cable with the other end connected to the center conductor of the coax cable.

As the power output of such antennas in the receiving case is increased by reducing the load resistance the operating bandwidth decreases, presenting the designer with a problem of selection; power output or bandwidth.

OBJECTS OF THE INVENTION

It is a principle object of the present invention to achieve maximum power output of a loop antenna for a given bandwidth of signal.

It is another object of the present invention to concurrently increase the bandwidth, the power output, or both, of a small loop antennas by reducing the inductance of the antenna.

Yet another object of the present invention is to optimize performance of loop antennas particularly where a substantial percentage of bandwidth is required together with reasonable power output.

Still another object of the present invention is to provide a microstrip antenna having good power output and wide bandwidth.

BRIEF DESCRIPTION OF THE PRESENT INVENTION

The invention applies mainly to those cases where the terminating resistance, considered as a series element is several times larger than the sum of the radiation resistance plus the antenna equivalent loss resistance.

The invention employs an inductive loop antenna, having, in one form, a coaxial cable transmission line providing the input/output lead. The antenna section may comprise the outer conductor of a coaxial line. One end of the antenna is connected to the outer conductor of the coaxial cable adjacent the input region to the transmission line of the cable with the other end connected to the center conductor of the coaxial cable.

In a simple case which is described below where the loop antenna is tuned by a single series capacitor, an operating frequency band is produced over which the output power decreases by 3db on both sides of its maximum at the center of the band. The equation defining this band of frequencies is $\Delta f_{-3db}=f_o/Q=f_o(R_t/2\pi f_o L_o)$. An increase in power at a given bandwidth or increase in bandwidth with a given power is obtained by controlling $R_t$ and $L_o$, hereinafter $L_a$. The power output in the reception mode is $V_{oc}^2/R_t$ wherein $V_{oc}$ is the voltage amplitude generated and $R_t$ is the load resistance terminating the antenna. Thus increased power output can be achieved while maintaining bandwidth constant if $R_t$ is reduced while at the same time the ratio of $R_t$ and $L_a$ is maintained constant by also reducing $L_a$.

The load resistance, $R_t$, can be reduced by inserting a transformer with a known ratio (for instance 4:1) between the center conductor of the coax line and the antenna element. If a 50 ohm input/output cable is employed, the resistance is reduced to 12.5 ohms. The transformer employed has bifilar windings on a toroid. The high resistance end of the transformer is connected to the center conductor of the coaxial transmission line.

The connection between the transmission line and the antenna may be double or triple tuned to further increase power output without materially affecting bandwidth. It is possible to put as many alternating series and shunt resonators as desired in order to further "square-up" the response, thus eliminating undesired frequencies outside the operating band. This aspect of the design has not been mentioned in the disclosure but, in some cases could provide valuable protection of the receiver against interference and even receiver damage from other sources.

The invention is also described as applied to a capacitive tuned loop and a construction in which a coaxial cable is soldered to a rectangular metal strip to further increase the power-bandwidth function by decreasing $L_a$, allowing the transformer to have a still larger transformation ratio.

The best results obtained to date are achieved by employing a flat strip antenna element to reduce the $L_a$ factor to a quite low level plus a transformer to reduce $R_t$.

The illustrations and examples given herein are applications to the situation in which the antenna is used for reception of signals from nearby sources of electromagnetic field. The principles that are disclosed herein also apply to the reverse case in which the antenna is connected to a signal generator. The principle of electromagnetic reciprocity guarantees that optimization of the antenna as a receiver will assure that it is an optimum transmitter as well. Finally, the only restriction on the method presented herein as regards the spacing of the transmitter and receiver antennas is that they be "loosely" coupled, i.e., changes in termination or orientation of either does not affect the input impedance of the other appreciably.

The above and other features, objects and advantages of the present invention, together with the best means contemplated by the inventor thereof for carrying out the invention will become more apparent from reading the following description of a preferred embodiment and perusing the associated drawings in which:

BRIEF DESCRIPTION OF THE DRAWINGS

FIG. 9 illustrates an antenna employing three tuned circuits;

FIG. 10 is a series of graphs illustrating the performance of various antennas of the type disclosed herein;

DETAILED DESCRIPTION OF THE PRESENT INVENTION

Figure 1A:
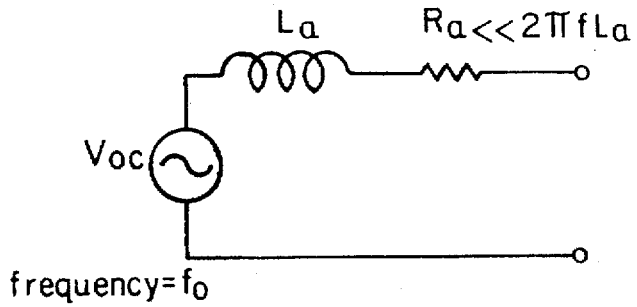
Fig.1a PRIOR ART
FIG. 1*a* is a circuit diagram of the equivalent circuit of a prior art small loop antenna.

Referring now to FIG. 1 of the accompanying drawings, there is illustrated the equivalent circuit of a small loop antenna wherein $V_{oc}$ is the induced voltage, $L_a$ represents the loop antenna inductance and $R_a$ represents the antenna resistance wherein $R_a<<2\pi f_o L_a$. Usually only a small fraction of $R_a$ is due to the radiation resistance; most is due to the resistance of the antenna conductor.

Figure 2:
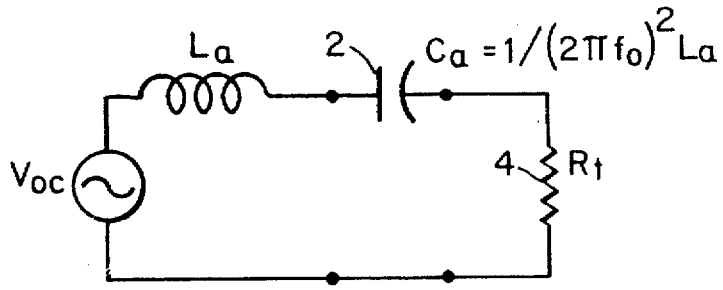
Fig.2 PRIOR ART
FIG. 2 is a circuit diagram of a prior art capacitively tuned small loop antenna.

To extract power from the conventional antenna described above, it is tuned by a capacitive element and terminated by a resistive element. A capacitive element is preferably inserted immediately following the antenna and between the antenna and the terminating resistance. Referring to FIG. 2, the capacitive element ($C_a$) is designated by reference numeral 2 wherein the resistive element is the load and the value of the capacitive element is equal to $1/(2\pi f_o)^2 L_a$ for an operating frequency $f_o$. In FIG. 2 the resistance of the antenna is not included since it is chosen to be insignificant relative to the receiver input resistance $R_r$.

The capacitance and inductance are chosen to be resonant at frequency $f_o$ which is at the middle of a band of operating frequencies. Under these circumstances and with negligible capacitive resistance, substantially all of the voltage induced in the antenna appears across the load resistance $R_r$.

The power output to the receiver at frequency $f_o$ is $V_{oc}^2/R_r$. The power output can be increased by reducing $R_r$, but the operating bandwidth is reduced as indicated by the formula $\Delta f_{3db}=R_r/2\pi L_a$, wherein $\Delta f_{3db}$ is the band of frequencies around the central frequency $f_o$ over which the output power varies by 3 db or less. The bandwidth can be increased by increasing $R_r$ but, as previously indicated, the power output is decreased unless $L_a$ is proportionally reduced.

Figure 1B:
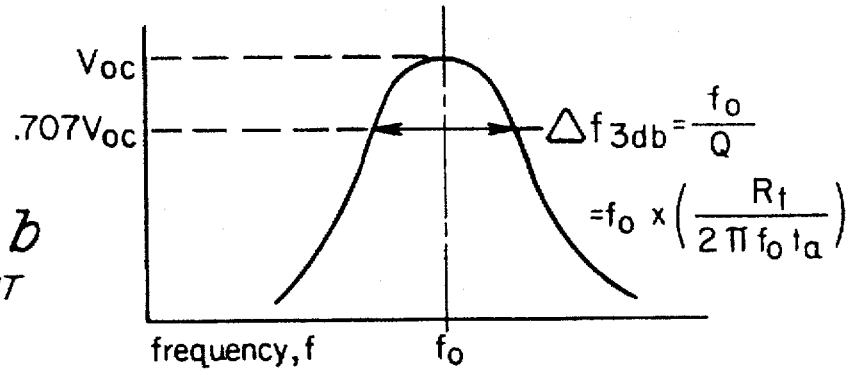
Fig.1b PRIOR ART
FIG. 1*b* illustrates the output voltage vs. frequency curve of a typical prior art capacitive tuned small loop antenna.
Figure 5:
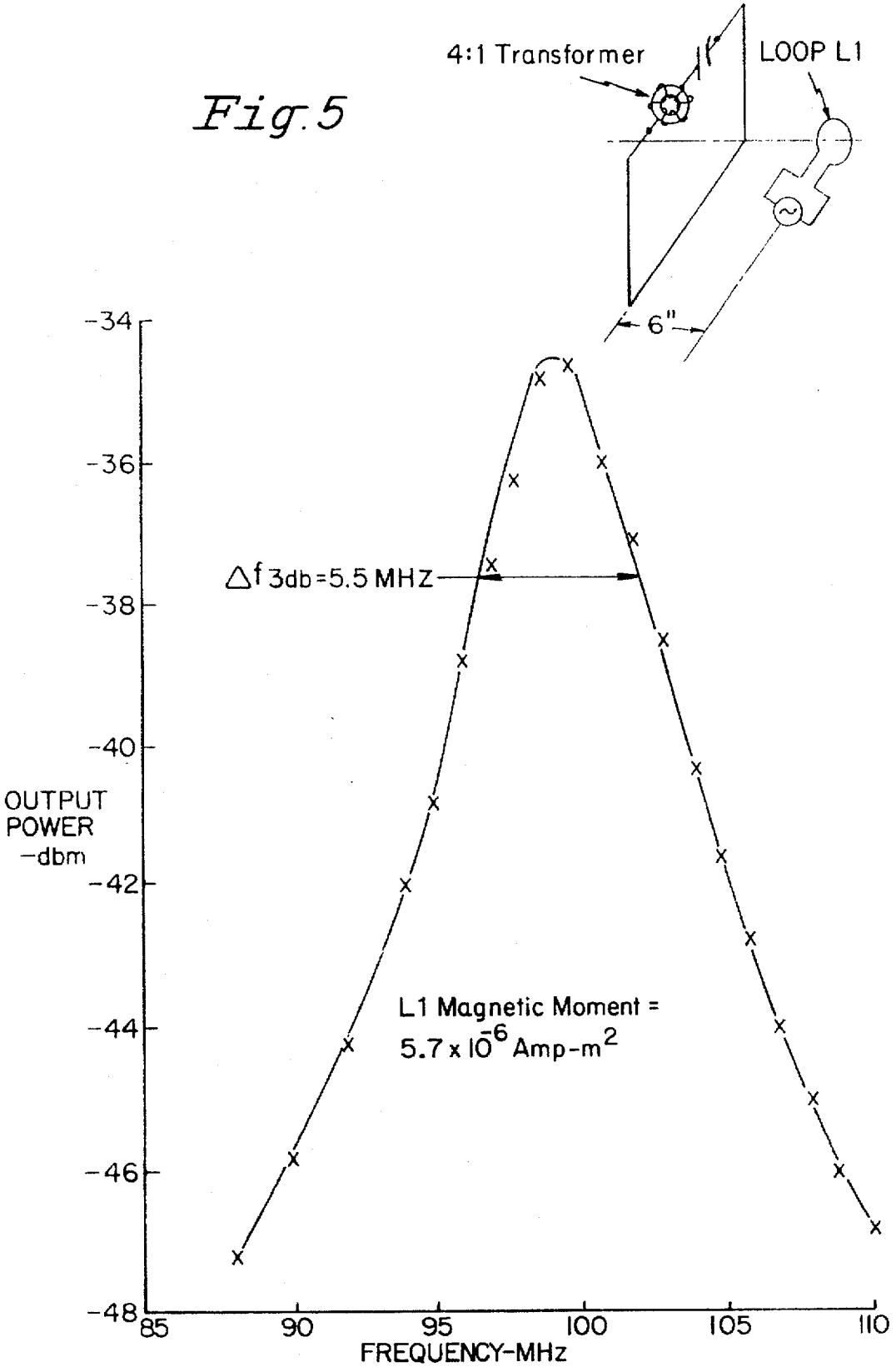
FIG. 5 illustrates a graph of the performance of the small loop antenna illustrated in FIG. 3.

FIG. 1*b* illustrates a curve indicative of the output voltage vs. frequency, $f_o$, of a capacitive tuned antenna while the lower graph of FIG. 5 illustrates the output power vs. frequency of a specific such antenna.

In accordance with the present invention, the power output of the antenna for a given constant bandwidth is increased by changing the coupling between the transmission line and the antenna section to reduce $R_r$ and providing an overall structure to reduce $L_a$ by the same factor as $R_r$.

Figure 4:
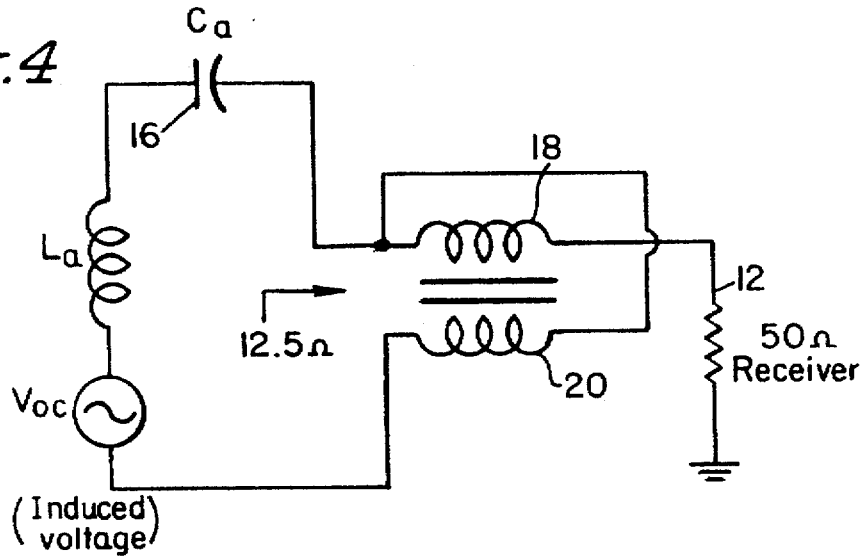
FIG. 4 is a circuit diagram of the bifilar transformer employed in FIG. 3.
Figure 3:
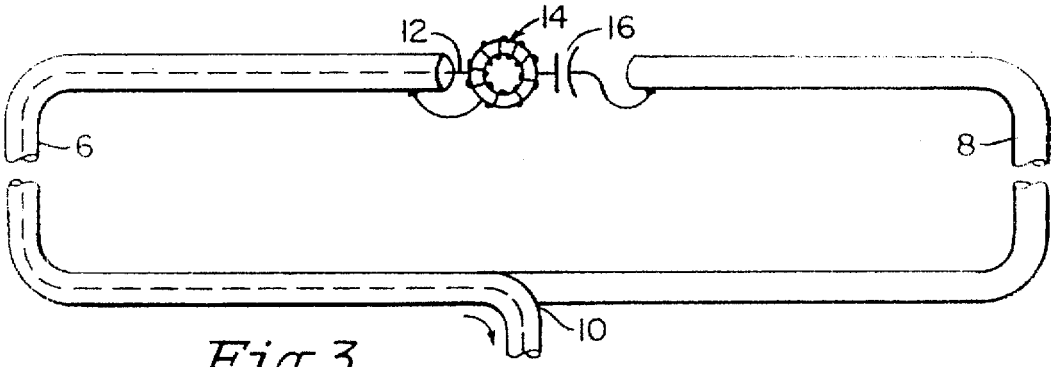
FIG. 3 is a circuit diagram of one embodiment of a loop antenna in accordance with the present invention.

Referring specifically to FIG. 3 of the accompanying drawings, the antenna is designated by reference numeral 8, which includes two U-shaped elements, one of which is the outer conductor of the coaxial cable 6. The coaxial cable 6, serves as a transmission line, and the elements 8 are physically connected at junction 10. Center conductor 12 of the coax cable 6 is connected to one winding of a bifilar transformer 14 having, for instance, a 4:1 impedance ratio. The interconnection of the bifilar windings, the tuning capacitor 16 and the cable 6 are clearly shown in FIG. 4. Center conductor 12 is connected through winding 18 to capacitor 16. The junction of winding 18 and capacitor 16 is connected through a second winding 20 of the bifilar windings to the outer conductor of the cable 6. The other end of the capacitor 16 is connected to $L_a$, the source of the signal. The capacitor is tuned to the inductance $L_a$ to provide a series resonant circuit.

In the case which was constructed to demonstrate the principle of operation, the characteristic impedance of the transmission line was 50 ohms. The high impedance side of the transformer is connected to the lead 12 so that the impedance $R_r$ reflected into the antenna circuit is 12.5 ohms. The transformer used is known as a "transmission line" transformer described by Jerry Sevich in an article entitled, "Transmission Line Transformers", Chapter 1, pp. 1–11, American Radio Relay League, Newington, Conn. (1990).

Referring now to FIG. 5, there is illustrated the output power vs. frequency of the circuit of FIG. 3. A small probe, loop L1 shown in FIG. 5, was used to couple a constant CW signal into the tuned loops one at a time and the power output was measured by a spectrum analyzer. The resulting bandwidth of the antenna of FIG. 3 at $\Delta f_{3db}$ was 5.5 MHz and the maximum power output was about −34.5 dbm with a probe loop magnetic moment of 5.7×10–6 AMP-M$^2$.

The 3 db bandwidth $\Delta f_{3db}$ of the same antenna described in the above paragraph but without the 4:1 bifilar transformer was 30 MHz but with a maximum power output of only −45 dbm. Thus the comparisons are: −34.5 dbm to −45.0 dbm and 5.5 MHz to 30 MHz, respectively.

Figure 6:
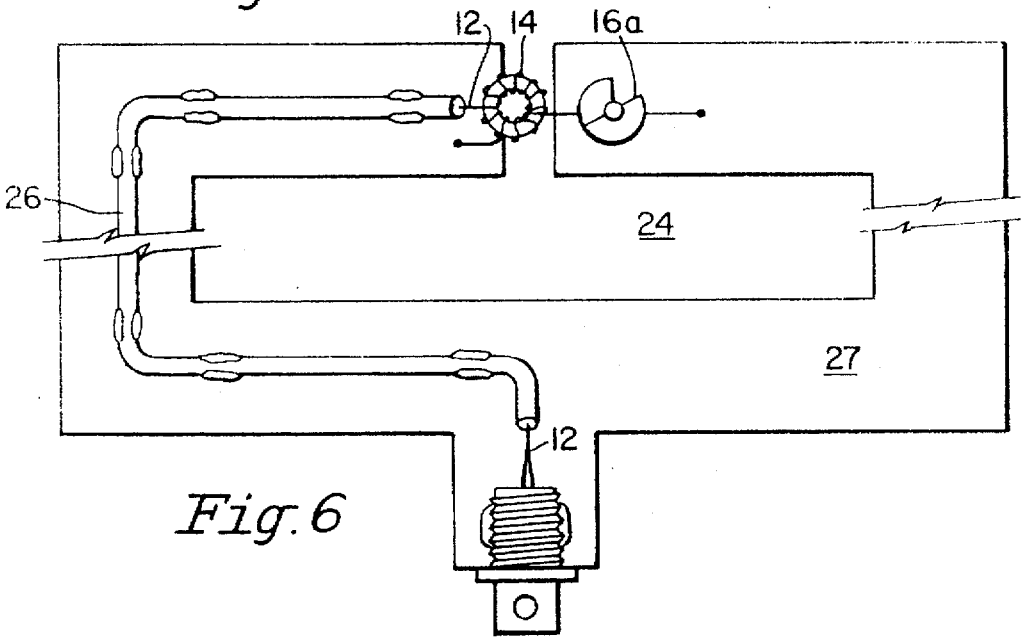
FIG. 6 is a diagram of a low inductance small loop antenna.

Referring now specifically to FIG. 6 of the accompanying drawings, there is illustrated a low inductance construction that permits a decrease in $L_a$. If it is desired only to increase the power output of the antenna then only $R_r$ must be reduced. If it is desired,to both increase the power output and maintain the bandwidth constant then the ratio $L_a/R_r$ must be maintained constant as well as reducing $R_r$. A flat strip loop construction may employ a copper clad printed circuit board 24, clad on both sides with a width of about one inch to create a lower inductance loop than the configuration of FIG. 3. The height of the board as viewed in FIG. 6 is 5 inches and the width is 7 inches with a one inch wide conductive band 27. A 50 ohm, 0.140 inch diameter coaxial cable 26 was soldered to the copper strip using the same coupling through a bifilar transformer and a series tuning capacitor 16*a* was employed as in FIG. 5. The same technique of measurement as illustrated in FIG. 5 was used with two different separations, 4 inches and 6 inches, of the probe from the antenna.

Figure 7:
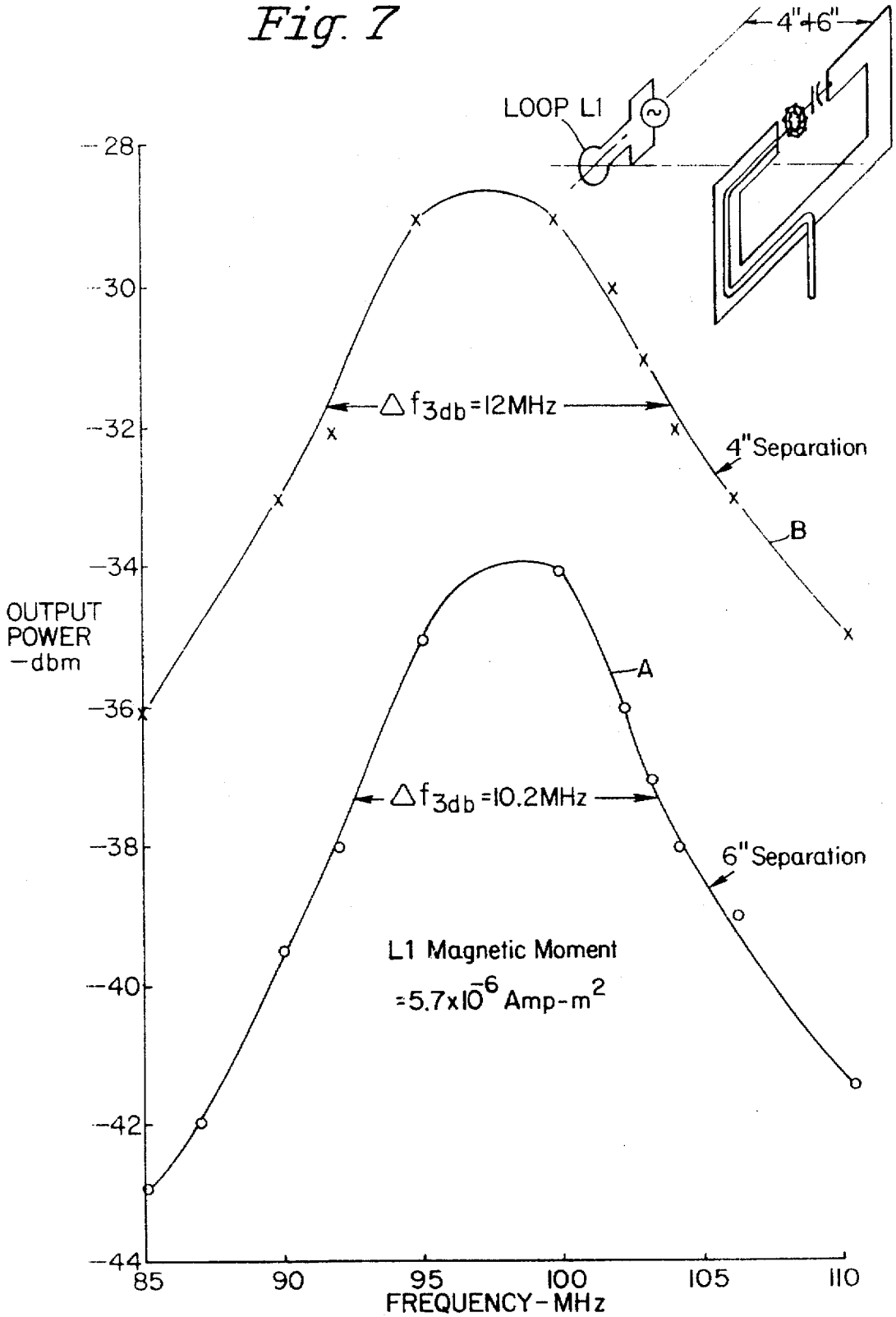
FIG. 7 illustrates two graphs of the performance of the antenna of FIG. 6.

Referring to FIG. 7, with a 6 inch separation, Curve A, the maximum power was the same as with the antenna of FIG. 3 but the bandwidth at the 3 db point was 10.2 MHz, thus almost doubling the bandwidth. This change resulted from lowering of the inductance of the antenna by use of the wide band of conductor 27. It is noted that with the loop located at 4 inches from the antenna, Curve B, the maximum power output was about −29 dbm with a 3 db bandwidth of about 12 MHz.

Figure 8:
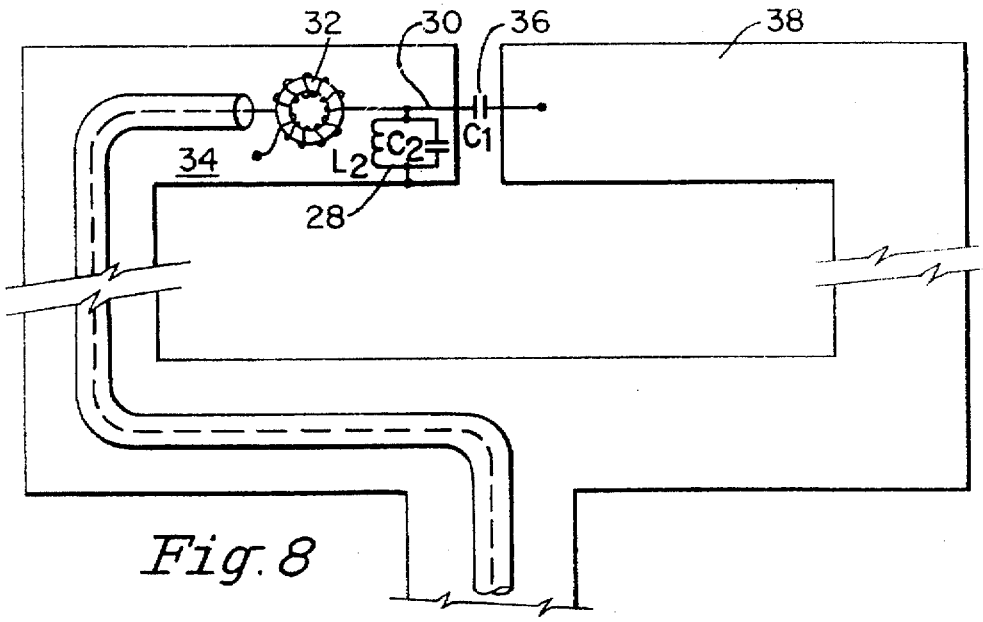
FIG. 8 illustrates a double tuned small low inductance loop antenna.

Referring to FIG. 8, there is illustrated a double tuned balanced loop antenna on a flat strip or plate 34 of the general type discussed relative to FIG. 6. In this construction the frequency response is squared up by use of a shunt resonator 28 connected between output lead 30 of bifilar transformer 32 and the antenna element or plate 34 and a capacitor 36 is connected between the transformer 32 and plate 38, the other element of the antenna. Power output is also somewhat enhanced without bandwidth reduction. The values of the various elements of this circuit are C36=12.2 picofarads, loop antenna inductance, =0.20 microhenry. In the tank circuit 28, the capacitance is 2080 picofarads and the inductance is 1.22 nanohenries for a center frequency of 100 MHz. These elements are terminated by a 12.5 ohm resistance which is transformed down from the 50 ohm coaxial line resistance level by the 4:1 bifilar transformer.

In order to further straighten the sides of the bandwidth characteristics the circuit of FIG. 9 may be employed. In this circuit, the elements $L_3C_3$ constituting a series tuned circuit have been added thus providing three tuned circuits $C_1L_1$ (as illustrated and discussed in FIG. 3), $L_2C_2$ the tank circuit of FIG. 7 and $L_3C_3$ of FIG. 8 for an added series tuned circuit. Again, power output is enhanced.

Reference is now made to FIG. 10 of the accompanying drawings There is displayed a number of graphs illustrating theoretical performance of normalized low frequency counterparts of several of the circuits discussed above. The vertical line "X" represents the edge of the desired band.

The Curve A results from the use of three tuned circuits such as to produce no ripple in the frequency response across the band. Curve B illustrates a three resonator tuned circuit of the Tchebycheff type and has an "equal-ripple" response to the band edge with a 0.2 db ripple. Both of Curves A and B have three tuned circuits. Curves C and D have one tuned circuit as illustrated in FIG. 2. Curve D is produced by a circuit having a very low Q while the circuit of Curve C has a higher Q.

Figure 11:
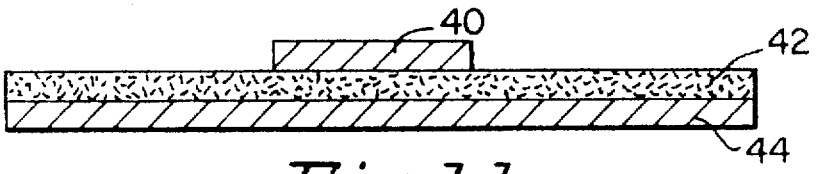
FIG. 11 illustrates a microstrip line.

Reference is now made to FIG. 11 of the accompanying drawings. There is illustrated the cross-section of a microstrip line having a narrow transmission line 45, an insulator 42 and a wide conductor 39.

Figure 12:
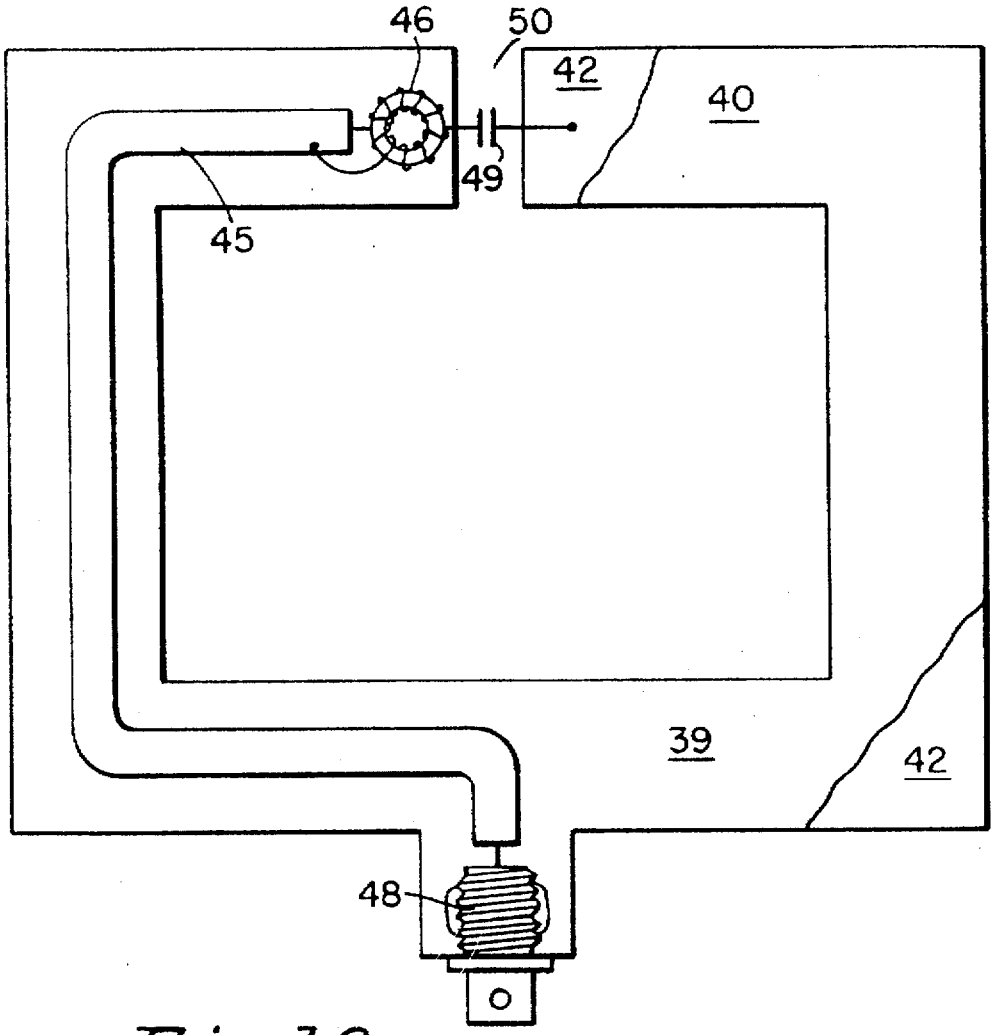
FIG. 12 illustrates an antenna fabricated from a microstrip.

Referring to FIG. 12, a bifilar winding transformer 46 is connected from end of the line 45 through a capacitor 49 across gap 50 to the element 40. The line 45 is connected at its other end to an I/O connector 48. Such construction is of low inductance, about the same as the antenna system of FIG. 6.

The circuit of FIG. 12 performs substantially the same as the circuit of FIG. 6 but is simpler to construct since the requirement of soldering a coaxial cable to a conductor is eliminated.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. An electrically small receiving antenna comprising a C-shaped transmission line having a signal conductor and a ground conductor, a C-shaped conductive antenna member having two ends and a predetermined inductance, one end of said antenna member connected to said ground conductor of said transmission line, and at least two impedance means connected in series between said signal conductor and the other end of said antenna member.

2. An electrically small receiving antenna according to claim 1 wherein one of said impedance means is a capacitor connected in series between said signal conductor and said other end of said antenna member.

3. An electrically small receiving antenna according to claim 1 wherein one of said impedance means is a transformer.

4. An electrically small receiving antenna according to claim 3 wherein said transformer has bifilar windings, and the other of said at least two impedances is a capacitor, said capacitor having one side connected to said antenna member and the other side connected to one of said windings of said transformer, and tuned to said predetermined inductance at the desired operating center frequency of the antenna.

5. An electrically small receiving antenna according to claim 4 wherein said other side of said capacitor is connected through one winding of said transformer to said antenna member, an output member, said other side of said capacitor further connected through another of said windings of said transformer to said output member.

6. An electrically small receiving antenna according to claim 1 further comprising a shunt resonator connected between said signal conductor and said ground conductor.

7. An electrically small receiving antenna according to claim 1 wherein said transmission line is a coaxial cable, and said antenna member is the outer conductor of a coaxial cable.

8. An electrically small receiving antenna according to claim 1 further comprising a flat rectangular conductive strip having a gap therein, said transmission line comprising a coaxial cable having an inner conductor and an outer metal conductor, said inner conductor constituting said signal conductor, said outer metal conductor and said C-shaped member lying on and having each end electrically connected, each to a different half of said conductive strip.

9. An electrically small receiving antenna according to claim 8 further comprising a shunt resonator connected between said inner conductor and said conductive strip adjacent said gap and said coaxial cable.

10. An electrically small receiving antenna according to claim 9 further comprising a series resonant circuit, and a capacitor connected from the series resonant circuit across said gap to the conductive strip.

11. An electrically small receiving antenna according to claim 10 wherein said series resonant circuit, said shunt resonator and said capacitor, together with said predetermined inductance, are all tuned to the desired center frequency of said antenna.

12. An electrically small receiving antenna according to claim 8 wherein said conductive strip and said transmission line are the two elements of a microstrip.

* * * * *